US009849959B1

(12) United States Patent
McDonald et al.

(10) Patent No.: US 9,849,959 B1
(45) Date of Patent: Dec. 26, 2017

(54) MARINE POD DRIVE SYSTEM

(71) Applicant: Caterpillar Inc., Peoria, IL (US)

(72) Inventors: Patrick McDonald, Livonia, MI (US); Andrew A. Hutchison, Fountain Inn, SC (US); Jonathan Steinbrink, Simpsonville, SC (US); Patrick Lee, Greenville, SC (US); Hashim M. Marzuq, Greer, SC (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/286,860

(22) Filed: Oct. 6, 2016

(51) Int. Cl.
*B63H 23/34* (2006.01)
*B63H 23/06* (2006.01)
*B63H 23/36* (2006.01)

(52) U.S. Cl.
CPC ..... *B63H 23/06* (2013.01); *B63H 23/36* (2013.01); *B63B 2758/00* (2013.01)

(58) Field of Classification Search
CPC ..... B63H 23/06; B63H 23/36
See application file for complete search history.

(56) References Cited

U.S. PATENT DOCUMENTS 2,961,988 A * 11/1960 Wood ..... B63H 5/1252 440/65
3,146,755 A 9/1964 Morse
3,407,779 A * 10/1968 Satterthwaite ..... B63H 23/326 384/220
5,688,152 A 11/1997 Rodskier
6,050,865 A 4/2000 Bohmann et al.
6,109,817 A * 8/2000 Burns ..... F16D 1/0864 403/305
6,247,979 B1 * 6/2001 Rigby ..... B63H 20/22 440/53
6,302,750 B1 * 10/2001 Foreman ..... B63H 20/002 277/336
7,073,474 B2 7/2006 Biel
8,845,267 B2 9/2014 Welz et al.
9,187,164 B2 11/2015 Schlintz et al.
2008/0131038 A1 * 6/2008 Sendzik ..... F16C 19/49 384/44
2015/0158572 A1 6/2015 Schlintz
2015/0166160 A1 6/2015 Schlintz et al.
2016/0052613 A1 2/2016 Anderson

* cited by examiner

*Primary Examiner* — Stephen P Avila

(57) ABSTRACT

A drive train in a marine vessel includes a marine pod drive unit and an inboard engine operatively connected by a driveshaft. To protectively enclose the driveshaft, a guard sleeve having a tubular configuration is disposed around the driveshaft and extends between the marine pod drive unit and the inboard engine. The first sleeve end of the guard sleeve is coupled to a first coupling collar on the marine pod drive unit using a first annular packing and the second sleeve end is coupled to a second coupling collar on the inboard engine using a second annular packing. The first and second annular packings enable relative angular displacement between the guard sleeve and the marine pod drive unit or the inboard engine.

17 Claims, 4 Drawing Sheets

MARINE POD DRIVE SYSTEM

TECHNICAL FIELD

This patent disclosure relates generally to power transmission in a marine vessel and, more particularly, to transmission of power from an inboard engine to a marine pod drive unit that vertically extends through the hull of the vessel.

BACKGROUND

Powerboats and other marine vessels are operatively powered by various types or configurations of marine drive systems. For example, in an inboard drive system, an inboard engine is completely located inside the hull of the vessel and rotates a driveshaft that extends through the hull and to which is attached the prop or propeller. In an outboard drive system, the engine and any shafts or gearing that connect the engine to the propeller are typically suspended over the transom or stern of the vessel such that the drive system is substantially disposed outboard of the hull. Recently, some drive systems of marine vessels have been configured to utilize one or more marine pod drive units, sometimes referred to azimuth thrusters. A marine pod drive unit typically includes an upper part or section that is fixedly disposed inboard of the vessel hull and a lower part or section that protrudes vertically through the bottom of the hull into the water and that supports the propeller in a generally horizontal orientation with respect to the hull. Further, the lower pod section is rotatably connected to the upper pod section so that it and the propeller can turn with respect to the upper pod section and the hull to steer the vessel. The motor and gearing to rotate the lower pod section with respect to the upper pod section may be disposed on the upper pod section along with clutches, transmission components, and the like to adjust the power output of the drive system.

To provide power to the marine pod drive unit, an internal combustion engine can be separately disposed inside the vessel hull and can be operatively connected to the upper pod section through a driveshaft. Possible advantages of physically separating the marine pod drive unit and the engine in this manner include that physical separation of components enables customized selection of different pod and engine combinations and that it protects the engine if the pod were to strike the seabed floor or underwater object. An example of this arrangement of a marine pod drive unit and an inboard engine is illustrated in FIG. 1 of U.S. Pat. No. 9,187,164 ("the '164 application"), which shows the inboard section of a marine pod drive unit receiving rotational power from a horizontally oriented driveshaft extending from the vessel's engine. The present disclosure is directed to a similar arrangement for transmitting rotational power from an inboard engine to a marine pod drive unit on a marine vessel.

SUMMARY

The disclosure describes, in one aspect, a marine drive system for a marine vessel including an inboard engine and a marine pod drive unit extending through the hull of the marine vessel. The inboard engine has an output shaft and the marine pod drive unit includes an input shaft. A driveshaft operatively connects the output shaft and input shaft. To protectively enclose the driveshaft, a guard sleeve having a tubular configuration is disposed around the driveshaft.

The guard sleeve include a first sleeve end coupled to the marine pod drive unit using a first annular packing to isolate vibrations and enable angular displacement of the guard sleeve and marine pod drive unit. The guard sleeve is further coupled to the inboard engine at a second sleeve end using a second annular packing to isolate vibrations and enable angular displacement between the guard sleeve and the inboard engine.

In another aspect, the disclosure describes a method of operatively connecting a marine pod drive unit and an inboard engine in a marine vessel. The method connects the input shaft of the marine pod drive unit and the output shaft of the inboard engine with a driveshaft. To protect the driveshaft, a guard sleeve having a tubular configuration is disposed around the driveshaft. A first sleeve end of the guard sleeve is coupled to a first coupling collar mounted to the marine pod drive unit with a first annular packing to isolate vibration. A second sleeve end of the guard sleeve is coupled to a second coupling collar mounted on the inboard engine with a second annular packing also included to isolate vibration.

In yet another aspect of the disclosure, there is disclosed a guard sleeve for protectively enclosing a driveshaft on marine vessel. The guard sleeve includes a tubular body extending between a first sleeve end and a second sleeve end and that has a sleeve diameter to accommodate a driveshaft. The first sleeve end is configured to receive a first coupling collar and has a first annular groove directed radially outward. The first annular groove can accommodate a first annular packing so that the first annular packing is sandwiched between the first sleeve end and a second annular groove disposed in the first coupling collar. The second sleeve end is configured to receive a second coupling collar and has a third annular groove that is directed radially outward. The third annular groove can partially accommodating a second annular packing disposed between the second sleeve end and the second coupling collar.

DETAILED DESCRIPTION

Figure 1:
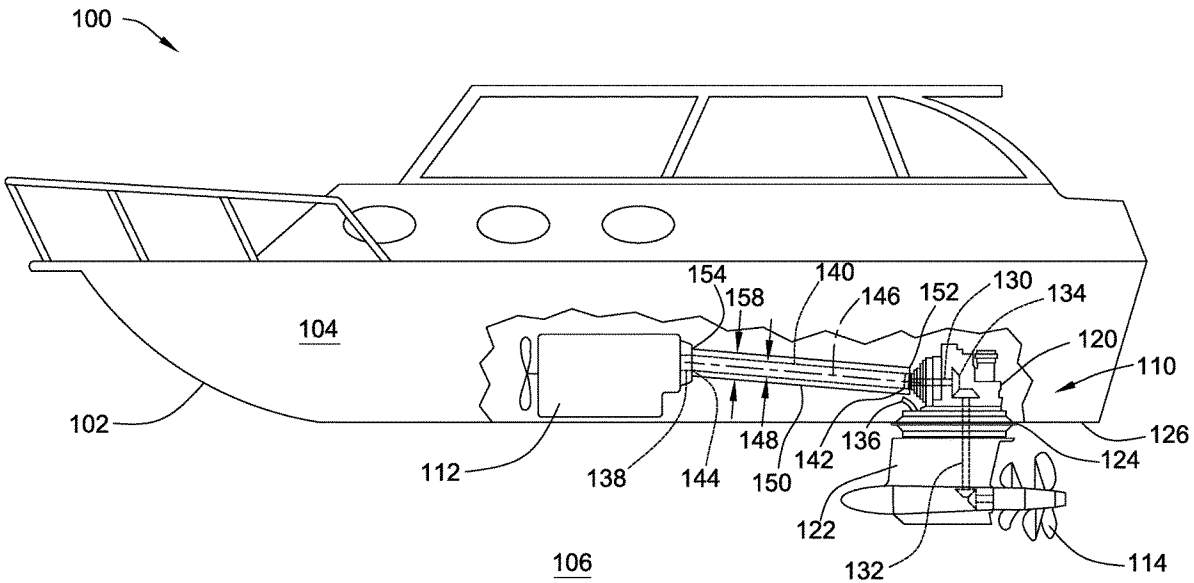
FIG. 1 is a schematic illustration of a marine vessel including a horizontally oriented driveshaft enclosed in a guard sleeve that extends between and operatively connects an inboard engine and a marine pod drive unit that extends through the bottom hull of the vessel.

This disclosure relates to the powertrain in a marine vessel and to ways of transmitting rotational power and torque between an inboard engine and a propeller supported in a marine pod drive unit. Referring to FIG. 1, there is illustrated a representative illustration of a marine vessel 100 in the particular form of a powered pleasure boat; however, the present disclosure may be implemented on any type of marine vessel including commercial vessels, military vessels, and the like. The marine vessel 100 includes a hull 102 that is the body of the vessel that is disposed in and interacts with the water. The hull 102 may have any particular shape and configuration known among marine designs, including V-hulled or flat-hulled, and can define the areas or components that are inboard 104 as opposed to outboard 106 of the marine vessel 100. To propel the marine vessel 100 in the water, the vessel can include a marine pod drive unit 110 that extends through the hull 102 and that is configured to receive and redirect kinetic power from a separately located inboard engine 112 to one or more propellers 114 that are typically positioned underwater to drive the vessel. To provide forward and/or aft thrust, the propellers 114 are typically oriented horizontally and parallel with respect to the longitudinal length of the hull 102.

The marine pod drive unit 110 can include an upper pod section 120 that is disposed inboard 104 and a lower pod section 122 that is disposed outboard 106 in the water and which supports the propellers 114 in a torpedo-shaped housing. The upper pod section 120 and the lower pod section 122 can interconnect with each other through an opening 124 disposed in the bottom wall 126 of the hull 102 using a stuffing box, packings, clamps, gland seals, and the like to ensure a water-tight seal is provided in the opening. The upper pod section 120 can include an externally protruding input shaft 130 to receive rotational power input and can include various clutches, gear sets, and transmission components to variably adjust the power input that drives the vessel. For example, to redirect rotational power from the input shaft 130, which may be oriented horizontally and parallel with the lengthwise extension of the hull 102, to the propellers 114 in the lower pod section 122, the marine pod drive unit 110 can include a vertical pod shaft 132 that engages with the input shaft 130 through a bevel gear set 134 or, in other embodiments, a differential gear set. In an embodiment, to provide cooling water to the inboard engine 112, the upper pod section 120 can include an intake water valve 136 that communicates with an intake grate or the like in the lower pod section 122 to receive water from outboard 106 through the hull 102.

To steer the marine vessel 100, in an embodiment, the lower pod section 122 can be configured to rotate or turn with respect to the upper pod section 120 and the hull 102. For example, the upper pod section 120 can be attached in a fixed manner inboard to the hull 102 and can interconnect with the lower pod section 122 through bearing assemblies that enable relative horizontal rotation between the upper and lower pod sections. The marine pod drive unit 110 can further include a servomotor and a gear arrangement that causes the lower pod section 122 to turn and redirect thrust from the propellers 114 in the water. In various embodiments, the marine vessel 100 can include a plurality of marine pod drive units 110 disposed on opposite sides of the hull 102 that function together in parallel or non-parallel operation to steer and maneuver the marine vessel 100.

To generate power for the marine pod drive unit 110, the inboard engine 112 can be an internal combustion engine of the type that combusts hydrocarbon-based fuels to convert the chemical energy therein to kinetic energy in the form of rotational torque delivered by an output shaft 138 protruding from the engine, which may be in the form of a crankshaft, engine flywheel, or any other type of engine coupling. In various embodiments, the inboard engine 112 can be a diesel burning, compression ignition engine or can be a gasoline burning, spark ignited engine. The inboard engine 112 can be fixedly attached to the hull 102 in, for example, an engine compartment or similar designated area. The inboard engine 112 can also be separate from and located remotely from the marine pod drive unit 110. Separating the inboard engine 112 from the marine pod drive unit 110 allows for positioning of the engine to better balance the vessel and can reduce potential damage to the engine in the event the marine pod drive unit strikes an underwater object. The marine pod drive unit 110 and the inboard engine 112 may be separated by any distance and, depending upon the size of the marine vessel 100, may be separated by a considerable distance on the order of several feet or meters.

To physically transmit torque and rotational power to the marine pod drive unit 110 from the inboard engine 112, a driveshaft 140 can disposed between the components and can be operatively coupled to the input shaft 130 and the output shaft 138. The driveshaft 140 can be a cylindrical, elongated structure and can extend between a first driveshaft end 142 and an oppositely oriented, second driveshaft end 144. The driveshaft 140 can be composed of a single integral part or multiple conjoined parts and typically is a solid structure of material having sufficient strength to withstand the torsion and sheer stresses it may encounter. The first driveshaft end 142 can be intended for connection to the input shaft 130 of the marine pod drive unit 110, for example, by a universal joint that allows for angular displacement of the shafts in multiple degrees of freedom, as is known in the art. In other embodiments, an elastomeric spider coupling or similar flexible coupling can be used to connect the driveshaft 140 and input shaft 130 that also allows for relative angular displacement between the shafts. The second driveshaft end 144 can be intended for similar connection to the output shaft 138 of the inboard engine 112 via a similar universal joint or spider to allow relative angular displacement of the shafts. The elongated driveshaft 140 may delineate a driveshaft axis line 146 extending between the first driveshaft end 142 and the second driveshaft end 144 that can be oriented generally horizontally with respect to the lengthwise extension of the hull 102. With respect to the embodiment of FIG. 1, in which the driveshaft 140 is illustrated at a slight downward angle extending from the inboard engine 112 to the marine pod drive unit 110, it should be appreciated the term "generally horizontally" allows for a scope of alignment different from perfectly horizontal in keeping with the nature of disclosed driveshaft as used in a marine vessel.

During operation, to prevent contact or interference with the rotating driveshaft 140 that may be spinning at several thousand RPM, a tubular guard sleeve 150 can be disposed radially around and extend axially along the driveshaft 140. In various embodiments, the guard sleeve 150 can be an extruded structure or, as explained below, can include multiple parts to facilitate assembly about the driveshaft. To accommodate the driveshaft 140, the guard sleeve 150 can be a hollow tubular casing having a sleeve diameter 158 larger than the driveshaft diameter 148 of the driveshaft 140 and can be generally coextensive in length with the driveshaft. When assembled, the guard sleeve 150 can extend between and be supported by the marine pod drive unit 110 and the inboard engine 112. Accordingly, the guard sleeve 150 provides a stationary, protective enclosure in which the driveshaft 140 rotates. To support the elongated guard sleeve 150 around the driveshaft 140, the guard sleeve 150 can include a first sleeve end 152 that is operatively coupled to the marine pod drive unit 110 and a second sleeve end 154 that is operatively coupled to the inboard engine 112 in manner that accommodates misalignment and reduces or isolates vibration from the active components.

Figure 2:
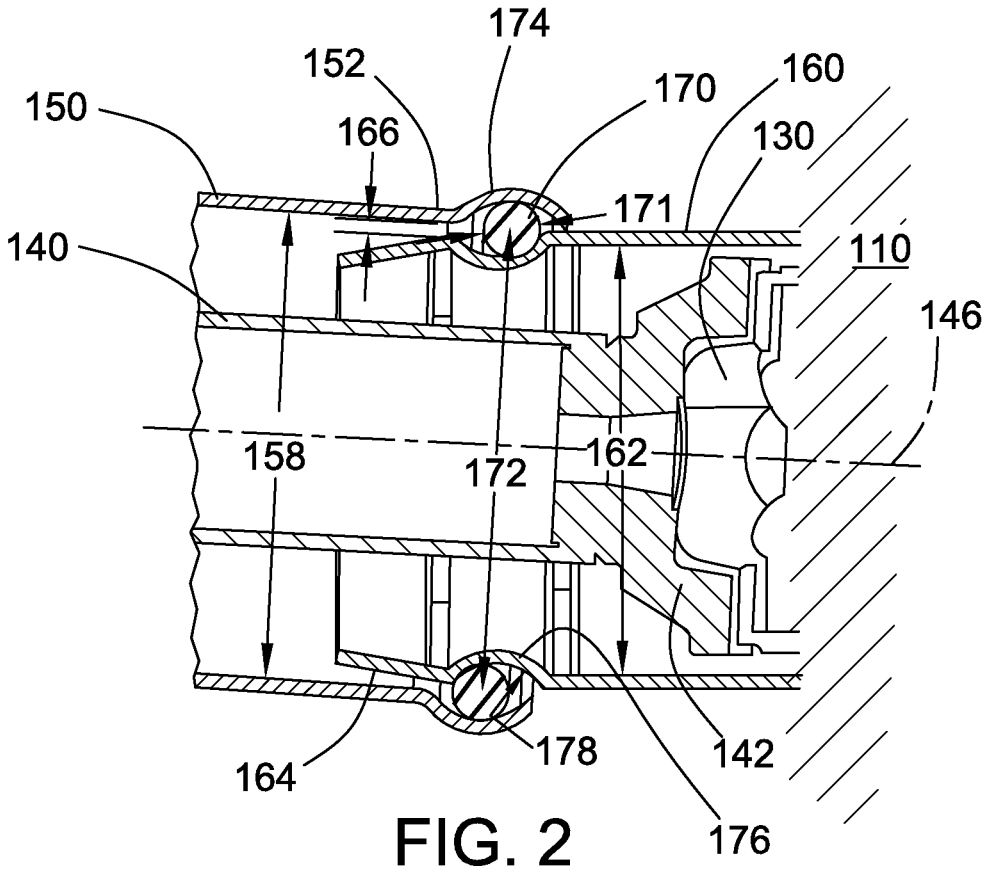
FIG. 2 is a cross-sectional image of the driveshaft interconnected to the input shaft of the marine pod drive unit and protected by the guard sleeve that is coupled to a coupling collar on the marine pod drive unit with an annular packing in accordance with the disclosure.

For example, referring to FIG. 2, there is illustrated an embodiment of the connection between the first driveshaft end 142 of the driveshaft 140 and the input shaft 130 protruding from the marine pod drive unit 110. The connection between the driveshaft 140 and the input shaft 130 is at least partially protectively enclosed by the first sleeve end 152 of the guard sleeve 150. To operatively couple with and support the tubular guard sleeve 150, the marine pod drive unit 110 can include a first coupling collar 160 having a similar tubular configuration that is fixedly attached to the upper pod section of the pod drive unit. The tubular first coupling collar 160 can be a thin-walled structure made from wrapped or extruded material and can be radially disposed around the exposed length of the input shaft 130 protruding from the upper pod section. To ensure the input shaft 130 is covered, the first coupling collar 160 may have an axial length greater than the exposed length of the input shaft 130 projecting from the marine pod drive unit.

In an embodiment, to join the first sleeve end 152 with the first coupling collar 160, in an embodiment, the first coupling collar can have a collar diameter 162 that is slightly smaller than the sleeve diameter 158. The difference in dimension between the collar diameter 162 and the sleeve diameter 158 enables the first coupling collar 160 to be inserted or received into the first sleeve end 152 of the guard sleeve 150. To further facilitate insertion, the first coupling collar 160 can be formed with a tapered distal end 164. The difference between the sleeve diameter 158 and the collar diameter 162, along with the tapered distal end 164, provides a gap or radial clearance 166 between the first sleeve end 152 and the first coupling collar 160. However, while the present embodiment illustrates the first coupling collar 160 dimensioned to be inserted into the guard sleeve 150, it should be appreciated the arrangement in other embodiments may be reversed with the first sleeve end 152 inserted into the tubular first coupling collar 160. The combination of the first sleeve end 152 and the first coupling collar 160 prevents unintentional access to the connection between the input shaft 130 and the driveshaft 140 and further can protect the intake water valve in the event the shaft connection should fail.

To dampen or isolate vibrations that may originate from the marine pod drive unit 110, the connection between the first sleeve end 152 of the guard sleeve 150 and the first coupling collar 160 can include a first annular packing 170 disposed at the interface between the first sleeve end 152 and first coupling collar 160. In an embodiment, the first annular packing 170 can be in the form of an o-ring made from a suitable elastomeric or resilient material such as natural or synthetic rubber, fluoroelastomers, nitrile rubber, silicone rubber, and the like, and/or blends thereof. Such resilient materials can volumetrically compress and recover under applied loads. The first annular packing 170 in the form of an o-ring may have a cross-sectional thickness 171 that is generally circular as illustrated, although in other embodiments, the first annular packing may have other profiles such as oval or elliptical, square or boxed, x-shaped, lipped, etc. Moreover, the annular shape of the first annular packing 170 enables it to be disposed radially around the first coupling collar 160 as illustrated. More specifically, the annular diameter 172 of the first annular packing 170 can be dimensioned so it can be disposed between and sandwiched by the first coupling collar 160 that is received and accommodated in the first sleeve end 152 of the guard sleeve 150. Accordingly, the annular diameter 172 can be slightly larger than the collar diameter 162 and slightly smaller than the sleeve diameter 158.

To further accommodate the first annular packing 170, the first sleeve end 152 of the guard sleeve 150 and the first coupling collar 160 can include complementary first and second annular grooves 174, 176 or indentations that circumferentially extend around the first sleeve end 152 and first coupling collar 160 respectively. The first and second annular grooves 174, 176 may be disposed in opposing orientations with the first annular groove 174 directed radially outward and the second annular groove 176 directed radially inward. Further, the first and second annular grooves 174, 176 can be curved or arched in shape as determined by the curvature of the grooves and indicated in FIG. 2 by as radius of curvature 178 associated with the grooves. In an embodiment, the degree or dimension of curvature of the radius of curvature 178 defining the curved shape of the first and second annular grooves 174, 176 can be equal to or larger than the curvature corresponding to the cross-sectional thickness 171 of the first annular packing 170. Accordingly, the width of the first annular packing 170 can fit within the first and second annular grooves 174, 176 as shown.

When assembled, the first annular groove 174 and the second annular groove 176 can axially align coextensively with each other to accommodate the first annular packing 170. Further, the oppositely directed radial orientation of the first and second annular grooves 174, 176 and the radius of curvature 178 causes the radial clearance 166 between the first sleeve end 152 and the first coupling collar 160 to increase. The cross-sectional thickness 171 of the first annular packing 170 may be dimensioned to cause a slight compressive fit between the first annular packing 170 and the first and second annular grooves 174, 176 in which it is accommodated. When retentively positioned in the first and second annular grooves 174, 176 between the first sleeve end 152 and the first coupling collar 160, the elastic characteristic of the first annular packing 170 can absorb and isolate vibrations transmitted between the components. Furthermore, as described below, the first annular packing 170 allows a limited range of relative angular motion between the guard sleeve 150 and the first coupling collar 160 to accommodate angular misalignment between them.

Figure 3:
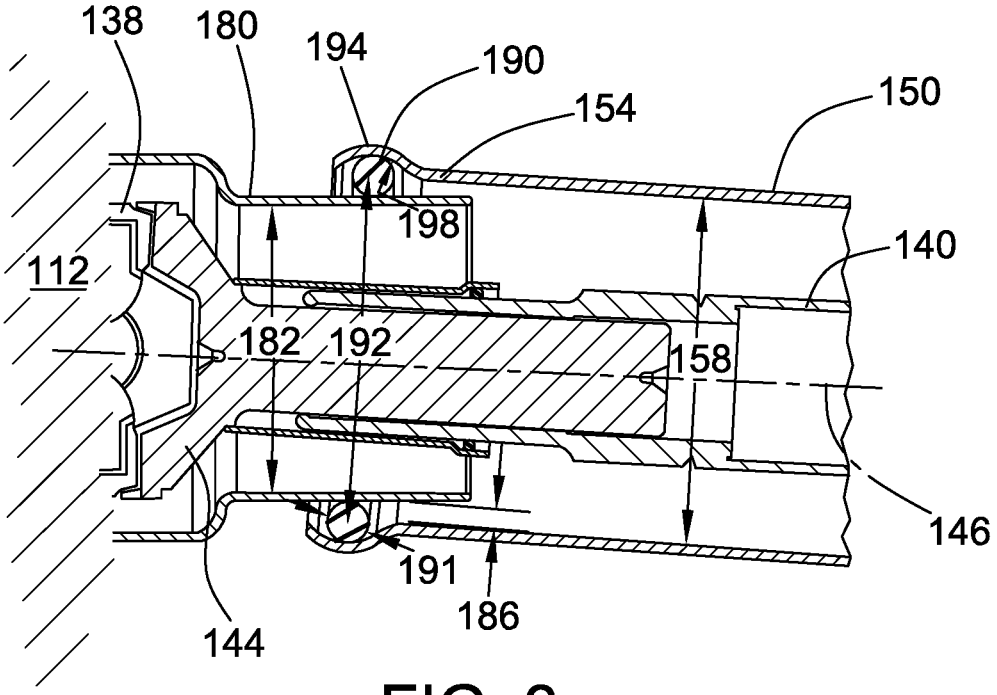
FIG. 3 is a cross-sectional image of the driveshaft interconnected to the inboard engine and similarly protected by the guard sleeve coupled to a coupling collar disposed on the engine with an annular packing.

Referring to FIG. 3, there is illustrated an embodiment of the connection at the oppositely located second driveshaft end 144 of the driveshaft 140 as coupled to the output shaft 138 of the inboard engine 112. To restrict access to the interconnection between the rotating output shaft 138 and the driveshaft 140, the connection can be protectively enclosed by the second sleeve end 154 of the guard sleeve 150. To join with and support the second sleeve end 154, the inboard engine 112 can have mounted thereon a second coupling collar 180, having a similar thin-walled, tubular configuration as the first coupling collar to radially extend about and to project over the exposed length of the output shaft 138. The second coupling collar 180 can have a collar diameter 182 that is again dimensioned to enable insertion of the second coupling collar into the larger sleeve diameter 158 associated with the second sleeve end 154 of the guard sleeve 150. The difference between the sleeve diameter 158 and the collar diameter 182 can produce a radial clearance 186 between the second sleeve end 154 and the second coupling collar 180.

To isolate or absorb vibrations originating from the inboard engine 112, a second annular packing 190 can be made from elastic or resilient material and can be disposed at the interface between the second sleeve end 154 and the second coupling collar 180. The second annular packing 190 can be an elastomeric o-ring similar to or the same as the first annular packing or can have a different size, profile, or configuration. For example, the second annular packing can have a cross-sectional thickness 191 that corresponds to a circular cross-section. Additionally, the second annular packing 190 can have a second annular diameter 192 sized to enable radial positioning around the second coupling collar 180 when received in the second sleeve end 154.

In a variation, the second annular packing 190 can be accommodated by a single, third annular groove 194 disposed into either the second sleeve end 154 as illustrated or, alternatively, in the second coupling collar 180. The third annular groove 194 can have a curved configuration designated by a curvature or a radius of curvature 198 that corresponds to or can be larger than the cross-sectional thickness 191 of the second annular packing 190 and, in the illustrated embodiment, can project radially outwards. In addition to dampening induced vibrations, the second annular packing 190 can accommodate various degrees of angular and axial misalignment between the second coupling collar 180 and the guard sleeve 150, for example, due to angular tilting of the driveshaft 140 away from the true horizontal plane.

Figure 4:
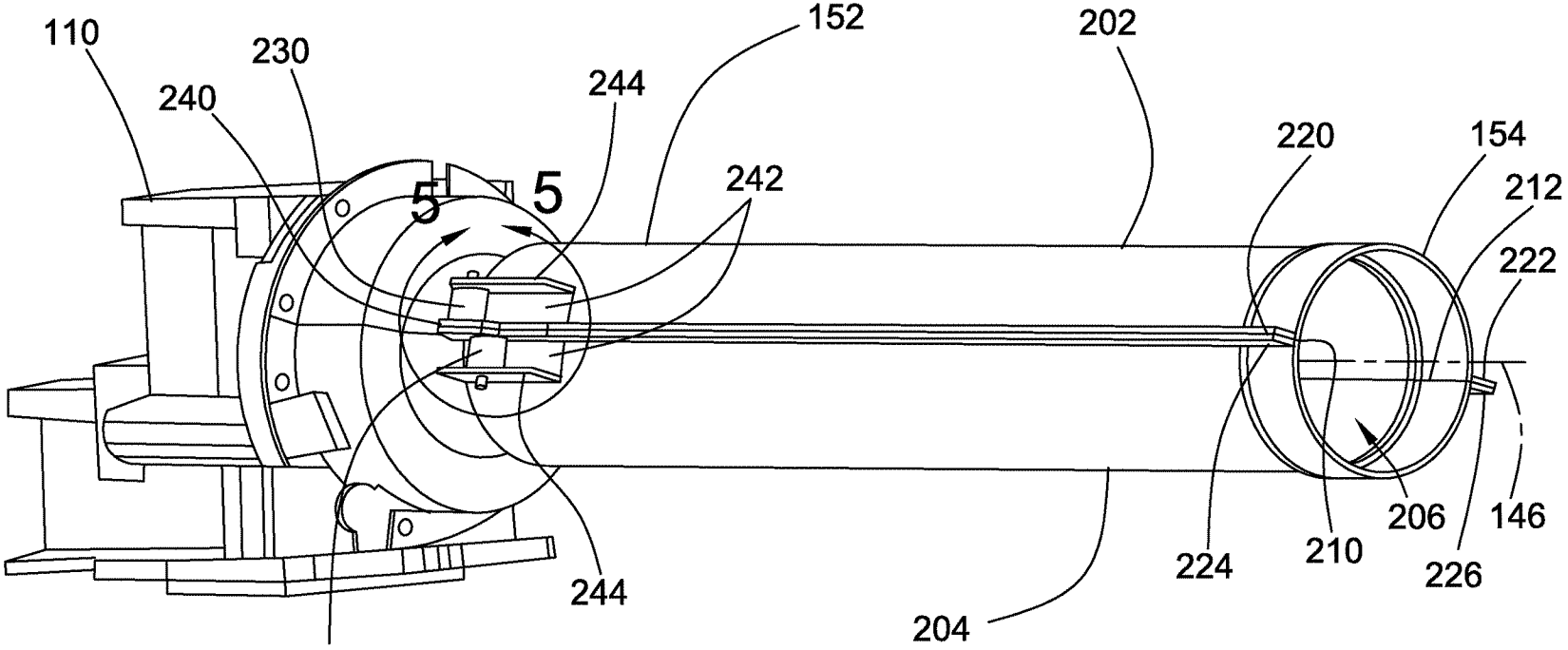
FIG. 4 is a perspective view of an embodiment of the guard sleeve including a first semi-cylindrical half and a second semi-cylindrical half that extend adjacent to each other around the driveshaft and that are joined together by vibration isolator mounts.

Referring to FIG. 4, there is illustrated an embodiment of the guard sleeve 150 that is specifically configured to facilitate assembly about the driveshaft extending between the marine pod drive unit 110 and an inboard engine (not shown). The guard sleeve 150 again extends axially along the driveshaft axis line 146 between the first sleeve end 152 and the second sleeve end 154 to provide a tubular enclosure for the driveshaft. To facilitate assembly, the guard sleeve 150 can be constructed from multiple parts including a first semi-cylindrical half 202 and a corresponding and complementary second semi-cylindrical half 204. As illustrated, both of the first and second semi-cylindrical halves 202, 204 can be axially elongated and are shaped as a partial cylinder. When the first and second semi-cylindrical halves 202, 204 are joined lengthwise about the driveshaft axis line 146, they provide a tubular bore 206 that can accommodate and encase the driveshaft. The first and second semi-cylindrical halves 202, 204 thereby simplify installation of the guard sleeve 150 about the driveshaft 140.

To join the first and second semi-cylindrical halves 202, 204 together, each semi-cylindrical half can be configured to abut each other lengthwise along their semi-cylindrical edges. Specifically, in the illustrated embodiment, the semi-cylindrical shaped curve or arc of the first and second semi-cylindrical halves 202, 204 can terminate at a first semi-cylindrical edge 210 and an opposite second semi-cylindrical edge 212. On the first semi-cylindrical half 202, a flat, planer first abutment flange 220 can project from the first semi-cylindrical edge 210 and a similar second abutment flange 222 can likewise project from the second semi-cylindrical edge 212. Both the first and second abutments flanges 220, 222 can extend along the axial length of the first semi-cylindrical half 202. Likewise, the second semi-cylindrical half 204 can include a similar third abutment flange 224 projecting from the first semi-cylindrical edge 210 and can include a fourth abutment flange 226 projecting from the second semi-cylindrical edge 212. When the first and second semi-cylindrical halves 202, 204 are assembled together, the abutment flanges 220, 222, 224, 226 extend radially outward from and parallel with respect to the driveshaft axis line 146 with the first and third abutment flanges 220, 224 and the second and fourth abutment flanges 222, 226 respectively abutting each other.

Figure 5:
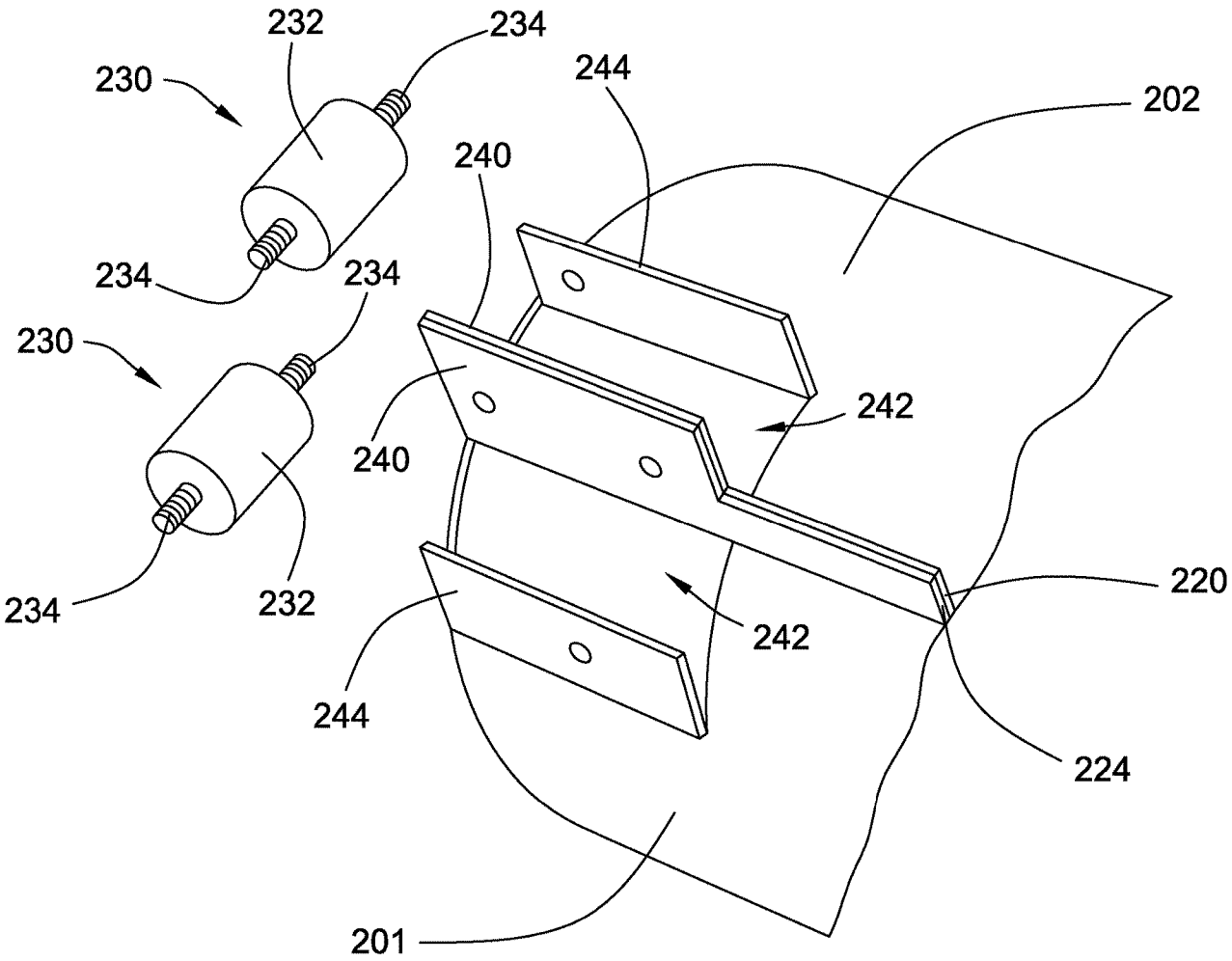
FIG. 5 is a perspective assembly view of the area indicated in FIG. 4 of an embodiment of the vibration isolator mount shown with respect to the first and second semi-cylindrical halves.

To couple the first and second semi-cylindrical halves 202, 204 of the guard sleeve 150 to the marine pod drive unit 110 in a manner that isolates vibration between the components, the first and second semi-cylindrical halves 202, 204 can be joined at the first sleeve end 152 using one or more vibration isolator mounts 230. Vibration isolator mounts 230 are a class of passive devices that can be rigidly mounted to interconnect two more structures and which include a flexible or vibration dampening portion to absorb or dissipate vibrations between the structures. An example of one embodiment of a vibration isolator mount 230 is illustrated in FIG. 5, which includes a cylindrical body 232 with threaded male studs 234 projecting from opposite ends. The cylindrical body 232 can be made from an elastomeric material to dampen or dissipate energy associated with the vibrations. However, other embodiments of the vibration isolator mounts can utilize gels, fluids, springs, meshes, or the like to absorb and dissipate vibratory forces. Moreover, the vibration isolator mounts can be joined to the structures using any suitable techniques such as clips, welding, adhesives, etc.

In the embodiment illustrated in FIGS. 4 and 5, to utilize the vibration isolator mounts 236, the portions of the abutment flanges proximate the first sleeve end 152 can extend radially outward and form flat, planar sleeve tabs 240 that extend adjacent to each other. The first sleeve end 152 of the guard sleeve 150 may also have one or more sleeve apertures 242 disposed through it that are proximate to the planar sleeve tabs 240. The sleeve apertures 242 may function as slots or openings to accommodate one or more collar tabs 244 projecting generally radially outward from the first coupling collar 160 to extend through the sleeve apertures. The sleeve tabs 240 and collar tabs 244 can be arranged in a spaced-apart manner to receive a vibration isolator mount 230 there between. Hence, the first sleeve end 152 of the guard sleeve 150 is further coupled to the first coupling collar 160 on the marine pod drive unit 110 in a vibration-isolated manner through use of the vibration isolator mounts 230. While FIGS. 4 and 5 illustrate the vibration isolator mounts 236, sleeve tabs 240, and collar tabs 244 on only one lateral side of the guard sleeve 150, it can be appreciated the same features may be present on the other lateral side of the guard sleeve. Further, although the illustrated embodiment shows two vibration isolator mounts 230 in a stacked arrangement, other embodiments can have different numbers of mounts in different arrangements. Further, different spacing arrangements for the sleeve and collar tabs 240, 244 can be used, while in other embodiments, the collar tabs 244 can be eliminated and the vibration isolator mounts 230 can be used only to securely clamp the sleeve tabs 240 together.

INDUSTRIAL APPLICABILITY

Referring to FIG. 1, the disclosed guard sleeve 150 and coupling arrangements provide vibration-isolating effects that support the guard sleeve when coupled to and suspended between a marine pod drive unit 110 and an inboard engine 112 to protectively enclose a driveshaft 140 operatively interconnecting those components. Vibrating forces may arise from operation of the inboard engine 112 due to the inherent reciprocal motion of the pistons in the combustion chambers during the combustion cycles and vibrations or shock loads may be generated from operation of the marine pod drive unit 110 that is subjected to various moments and applied forces through action of the propellers 114 and the water. Referring to FIGS. 2 and 3, inclusion of the first and second annular packings 170, 190 at the interfaces where the tubular first and second sleeve ends 152, 154 receive the respective first and second coupling collars 160, 180 provides the vibration isolated characteristics.

At the marine pod drive unit 110, the circular cross-section of the first annular packing 170 and its accommodation in the first and second annular grooves 174, 176 enables the guard sleeve 150 (and the enclosed driveshaft 140) to tilt out of angular alignment with the input shaft from the marine pod drive unit 110. The radial clearance 166 between the first sleeve end 152 and the first coupling collar 160 provides spacing that further enables those parts angularly articulate with respect to each other without locking up. Accordingly, in this aspect, sliding or rolling motion between the first annular packing 170 and the first and second annular grooves 174, 176 in which it is disposed functions as a pivotal joint or linkage enabling the guard sleeve 150 to articulate angularly with respect to the output shaft 138, as indicated by the angular offset of the driveshaft axis line 146. Furthermore, the cross-sectional thickness 171 of the first annular packing 170 and the radial clearance 166 provided between first and second annular grooves 174, 176 can cause a compression fit compressing the first annular packing 170. The compressed first annular packing 170 can constrain axial motion between the first sleeve end 152 of the guard sleeve 150 and the first coupling collar 160, preventing the parts from decoupling. Specifically, it can be appreciated if the coextensive first and second annular grooves 174, 176 where to move axially with respect to each other, the radial clearance 166 defined between the grooves would shrink. Hence, first annular packing 170 as accommodated in the space provided between the first and second annular grooves 174, 176 would be further compressed in the shrinking radial clearance 166 to such an extent any further compression is not possible. The first annular packing 170 would thereafter functions as a lock or obstacle to relative axial movement of the first sleeve end 152 and the first coupling collar 160.

At the inboard engine 112, rolling or sliding motion between the circular cross-section of the second annular packing 190 and the radius of curvature 198 of the third annular groove 194 also enables the guard sleeve 150 to tilt angularly with respect to the second coupling collar 180. The radial clearance 186 between the second sleeve end 154 and the second coupling collar 180 also provides spacing that enables those parts to angularly articulate with respect to each other without locking up. However, because the second annular packing 190 is received only in the single third annular groove 194, the second sleeve end 154 can experience a degree of axial movement with respect to the second coupling collar 180. More specifically, because the radial clearance 186 between the second sleeve end 154 and the second coupling collar 180 is substantially fixed, no further compressive forces are induced on the second annular packing 190 if the second sleeve end 154 and the second coupling collar 180 axially move relative to each other. The second annular packing 190 can therefore slide or roll partially along the axial extension of the second coupling collar 180. This enables the coupling connection between the second sleeve end 154 of the guard sleeve 150 and the second coupling collar 180 to accommodate relative axial motion due to, for example, thermal expansion of the parts.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A marine drive system for a marine vessel comprising:

an inboard engine having an output shaft disposed inside a hull of the marine vessel;

a marine pod drive unit extending through the hull of the marine vessel, the marine pod drive unit including an input shaft;

a driveshaft operatively connecting the output shaft and the input shaft;

a guard sleeve having a tubular configuration and protectively enclosing the driveshaft, the guard sleeve coupled to the marine pod drive unit at a first sleeve end through a first annular packing to isolate vibrations and enable angular displacement of the guard sleeve and the marine pod drive unit, the guard sleeve further coupled to the inboard engine at a second sleeve end through a second annular packing to isolate vibrations and enable angular displacement between the guard sleeve and the inboard engine.

2. The marine drive system of claim 1, further comprising a first coupling collar mounted to the marine pod drive unit, wherein the first annular packing is disposed between the first sleeve end and the first coupling collar.

3. The marine drive system of claim 2, wherein the first sleeve end includes a first annular groove and the first coupling collar includes a second annular groove with the first annular packing accommodated in the first annular groove and second annular groove.

4. The marine drive system of claim 3, wherein the first annular packing is an o-ring comprised of elastic material.

5. The marine drive system of claim 4, wherein the first annular packing constrains relative axial movement between the first sleeve end and the first coupling collar.

6. The marine drive system of claim 5, wherein the first coupling collar is inserted into the first sleeve end.

7. The marine drive system of claim 2, further comprising a second coupling collar mounted to the inboard engine, wherein the second annular packing is disposed between the second sleeve end and the second coupling collar.

8. The marine drive system of claim 7, wherein the second sleeve end includes a third annular groove and the second annular packing is accommodated in the third annular groove.

9. The marine drive system of claim 8, wherein the second annular packing is an o-ring comprised of elastic material.

10. The marine drive system of claim 9, wherein the second annular packing allows relative axial motion between the second sleeve end and the second coupling collar.

11. The marine drive system of claim 7, wherein the first coupling collar has a tubular configuration and is disposed radially about the input shaft and the second coupling collar has a tubular configuration and is disposed radially about the output shaft.

12. The marine drive system of claim 1, wherein the guard sleeve includes a first semi-cylindrical half and a second semi-cylindrical half joined together.

13. A method of operatively connecting a marine pod drive unit and an inboard engine in a marine vessel comprising:

connecting a driveshaft between an input shaft of the marine pod drive unit and an output shaft of the inboard engine;

disposing a guard sleeve having a tubular configuration around the driveshaft;

coupling a first sleeve end of the guard sleeve to a first coupling collar mounted to the marine pod drive unit with a first annular packing disposed there between;

coupling a second sleeve end of the guard sleeve to a second coupling collar mounted on the inboard engine with a second annular packing disposed there between; and accommodating the first annular packing in a first annular groove disposed in the first sleeve end and in a second annular groove disposed in the first coupling collar.

14. The method of claim 13, further comprising accommodating the second annular packing in a third annular groove disposed in the second sleeve end.

15. The method of claim 14, wherein the step of coupling the first sleeve end to the first coupling collar includes inserting the first coupling collar into the first sleeve end; and the step of coupling the second sleeve end to the second coupling collar includes inserting the second coupling collar into the second sleeve end.

16. A guard sleeve for protectively enclosing a driveshaft on a marine vessel, the guard sleeve comprising:

a tubular body extending between a first sleeve end and a second sleeve end, the tubular body having a sleeve diameter to accommodate a driveshaft;

the first sleeve end configured to receive a first coupling collar and having an first annular groove disposed there at, the first annular groove directed radially outward and partially accommodating a first annular packing disposed between the first sleeve end and a second annular groove in the first coupling collar; and the second sleeve end configured to receive a second coupling collar and having a third annular groove disposed there at, the third annular groove directed radially outward and partially accommodating a second annular packing disposed between the second sleeve end and the second coupling collar.

17. The guard sleeve of claim 16, wherein the guard sleeve includes a first semi-cylindrical half and a second semi-cylindrical half that are joined together.

* * * * *